US009247772B2

(12) United States Patent
Mehio

(10) Patent No.: US 9,247,772 B2
(45) Date of Patent: Feb. 2, 2016

(54) ACTUATING HOOKAH BOWL

(71) Applicant: Nizar Youssef Mehio, Tallet El Khayet (LB)

(72) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 281 days.

(21) Appl. No.: 14/058,725

(22) Filed: Oct. 21, 2013

(65) Prior Publication Data

US 2014/0041676 A1 Feb. 13, 2014

Related U.S. Application Data

(62) Division of application No. 12/944,081, filed on Nov. 11, 2010, now Pat. No. 8,590,541.

(51) Int. Cl.

| | |
|---|---|
| ***A24F 25/02*** | (2006.01) |
| ***A24F 11/00*** | (2006.01) |
| ***A24F 1/30*** | (2006.01) |

(52) U.S. Cl.
CPC ..... *A24F 1/30* (2013.01)

(58) Field of Classification Search
None
See application file for complete search history.

(56) References Cited

U.S. PATENT DOCUMENTS

| | | | |
|---|---|---|---|
| 3,312,223 | A | 4/1967 | Fassbender |
| 3,413,980 | A | 12/1968 | Pollock |
| 3,834,402 | A | 9/1974 | Paul |
| 4,257,432 | A | 3/1981 | Griffith |
| 6,354,301 | B2 | 3/2002 | McCoy |

*Primary Examiner* — Richard Crispino
*Assistant Examiner* — Phu Nguyen
(74) *Attorney, Agent, or Firm* — Da Vinci's Notebook, LLC

(57) ABSTRACT

A hookah bowl, hookah utilized the hookah bowl, and process for using a hookah is disclosed. The hookah bowl includes two principal members, a bowl shell and an adjustable bowl burner that alters its position within the bowl shell. The bowl burner may adjust its position longitudinally, radially, or both.

4 Claims, 7 Drawing Sheets

ACTUATING HOOKAH BOWL

CROSS-REFERENCE TO RELATED APPLICATIONS

The present application is a continuation of and claims the benefit of U.S. application Ser. No. 12/944,081 filed Nov. 11, 2010, and is incorporated herein by reference in its entirety.

FIELD OF THE INVENTION

The present invention relates to the field of wetted-smoke smoking devices and more specifically to the field of hookahs.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a base, a stem, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah base, which is a cavern containing water. The base of the hookah is typically fabricated of glass or plastic and tends to be the most expressive portion of the hookah, ranging from translucent to wildly-colored. Within the cavern of the hookah base, the massell smoke is cooled by the water within. The cooled massell smoke then returns to the stem, though not through the same entrance by which the massell smoke enters the base. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

Massell is burned within a hookah bowl at a variable rate that primarily relates to the distance between ignited coals and available massell. The quantity of coal and massell within the bowl diminishes over time. The arrangement of coal and massell shifts over time. The initial placement of the coal and massell is hardly ever uniform, and to the extent that it may initially be substantially uniform, the diminishment of coal and massell leads to eventual discontinuities. Therefor there is a need for a bowl that permits effective smoking irrespective of coal and massell quantity, arrangement, and discontinuity.

SUMMARY

The present invention is directed to an actuating hookah bowl, hookah, and process for using a hookah. The hookah bowl includes a shell, a burner, a retainer member, and a massell platform. The shell includes a proximal and distal aperture bounded by an interior sidewall. The interior of the shell forms a void that permits placement of the burner. The burner fits within the retainer wall portion of the interior sidewall. The burner includes a height at least approximately equal to the height of the shell. A burner base wall at the bottom of the burner supports coals and includes perforations to permit heat to travel down to the massell platform.

Within the shell a retainer member supports the burner to permit the burner to be suspended above the massell platform. The burner, however, may traverse the retainer member both longitudinally, radially, or both. The burner, in its radial motion, may turn within the shell to position coals above desired portions of the massell. The burner, in its longitudinal motion, may position itself at a desired distance from the massell to regulate the rapidity with which the massell may be consumed by combustion. The preferred retainer member is an elastic retainer capable of compression suited to achieve the aforementioned purposes.

The burner is preferable completely removable from the shell and is dimensioned to form an empty, open cylinder. The burner is positioned directly above the massell platform. The massell platform extends across the proximal aperture and includes perforations that do not prevent passage of massell through the platform or the proximal aperture. The massell platform may be integrally affixed to the shell or may comprise a removable screen.

Therefore, it is an aspect of the present invention to provide a hookah bowl capable of effectively regulating the combustion of massell.

It is a further aspect of the present invention to provide a hookah bowl capable of internal positioning of internal coals with respect to massell, both longitudinally and radially.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
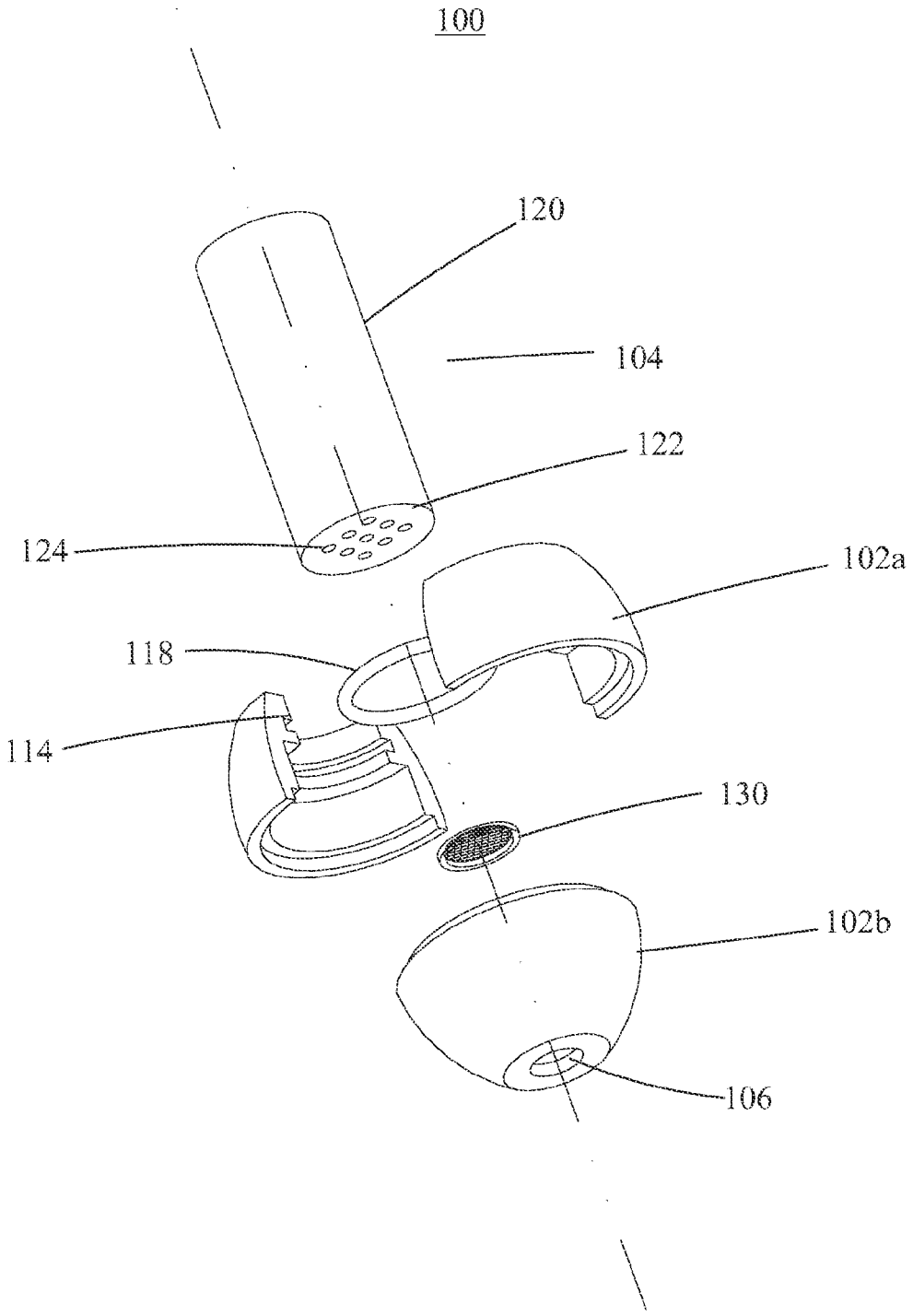
FIG. 1 is a side exploded, divisional view of the hookah bowl.
Figure 2:
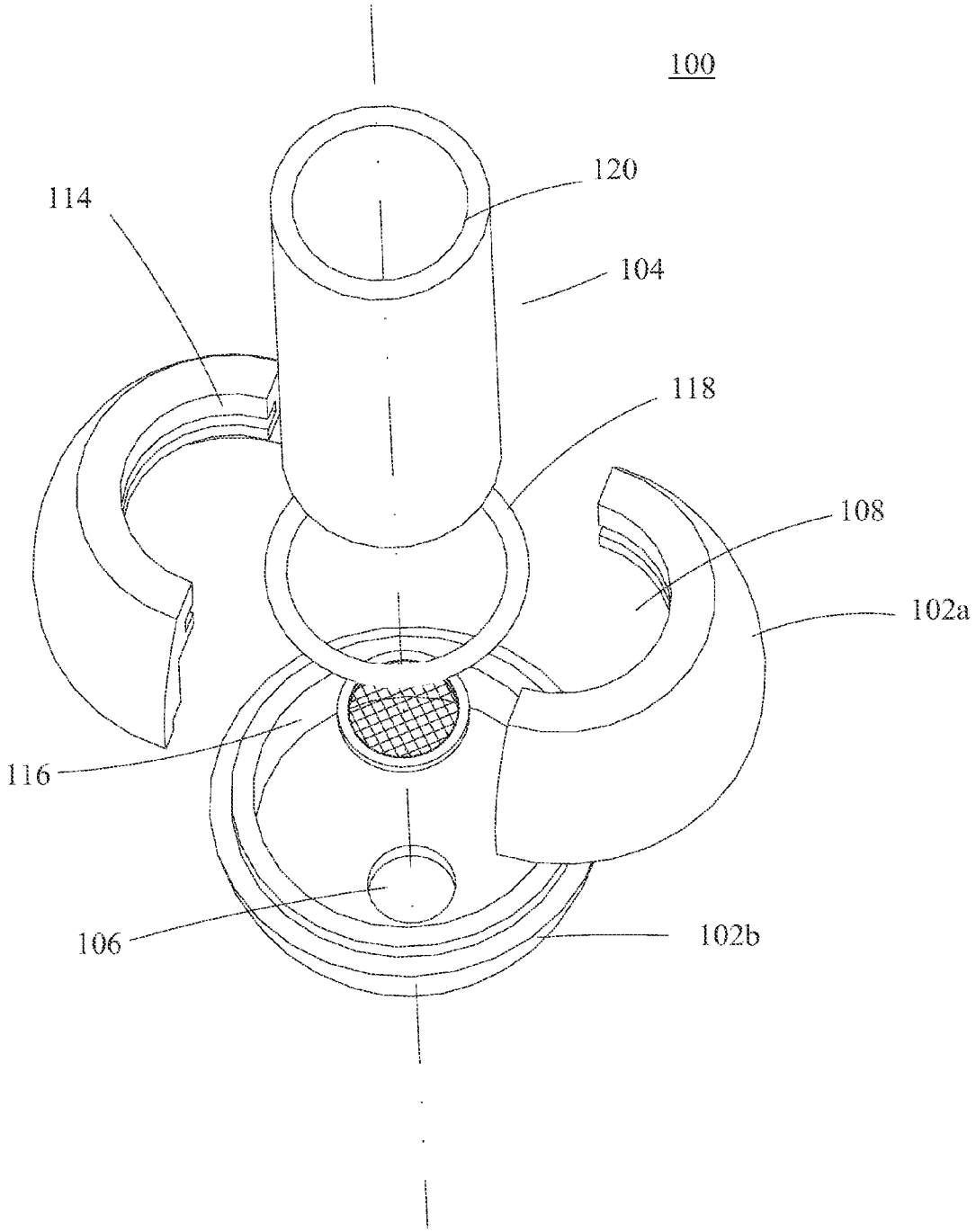
FIG. 2 is an upper exploded, divisional view of the hookah bowl.
Figure 3:
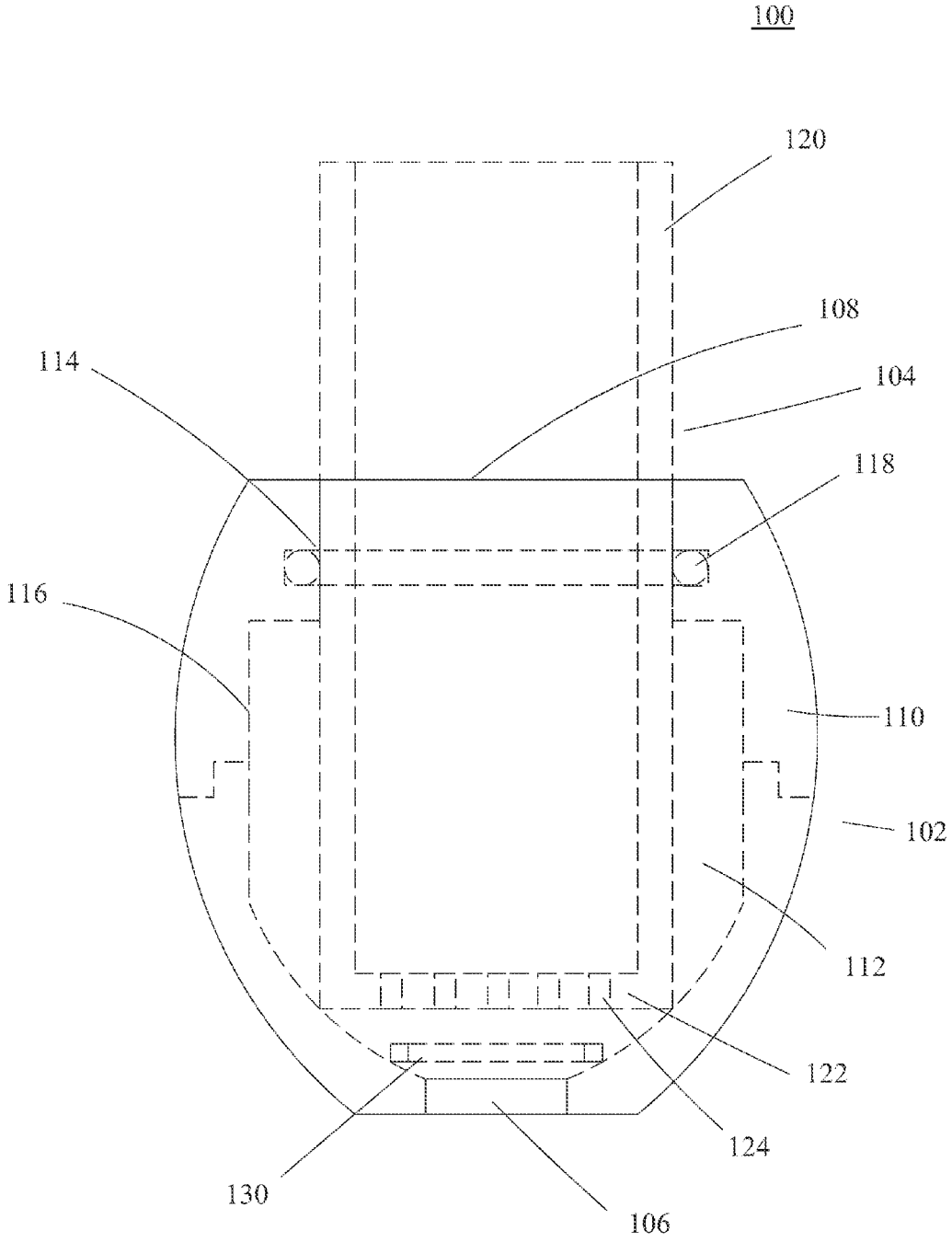
FIG. 3 is an exposed, orthographic view of the hookah bowl.

Referring first to FIGS. 1-3, a basic embodiment of the hookah bowl 100 is shown. The hookah bowl 100 includes a hookah bowl shell 102 and a hookah bowl burner that fits within the shell 102. The shell 102 defines a proximal aperture 106 for passage of dry smoke to a hookah stem (not shown), and preferably for attachment of the shell 102 to a hookah stem. The shell defines a distal aperture 108 sized to allow the placement of an aggregation of massell within the hookah shell 102 and accommodate the burner 104. An interior sidewall 110 of the shell 102 defines a central shell void 112 into which the burner 104 and massell may pass and occupy. The interior sidewall 110 may be conceptually divided into two portions: a retainer wall 114 and a smoke wall 116. Although the retainer wall 114 and smoke wall 116 may in certain embodiments of the present invention be indistinguishable, preferred embodiments of the bowl shell may feature a retainer wall 114 with a circumference smaller than that of the smoke wall 116. The retainer wall 114 includes a substantially uniform retainer wall circumference. A retainer wall that is substantially uniform includes dimensions that allow a retainer member 118 to be positioned against an outer wall 120 of the burner 104 in a sealed fashion.

Figure 4:
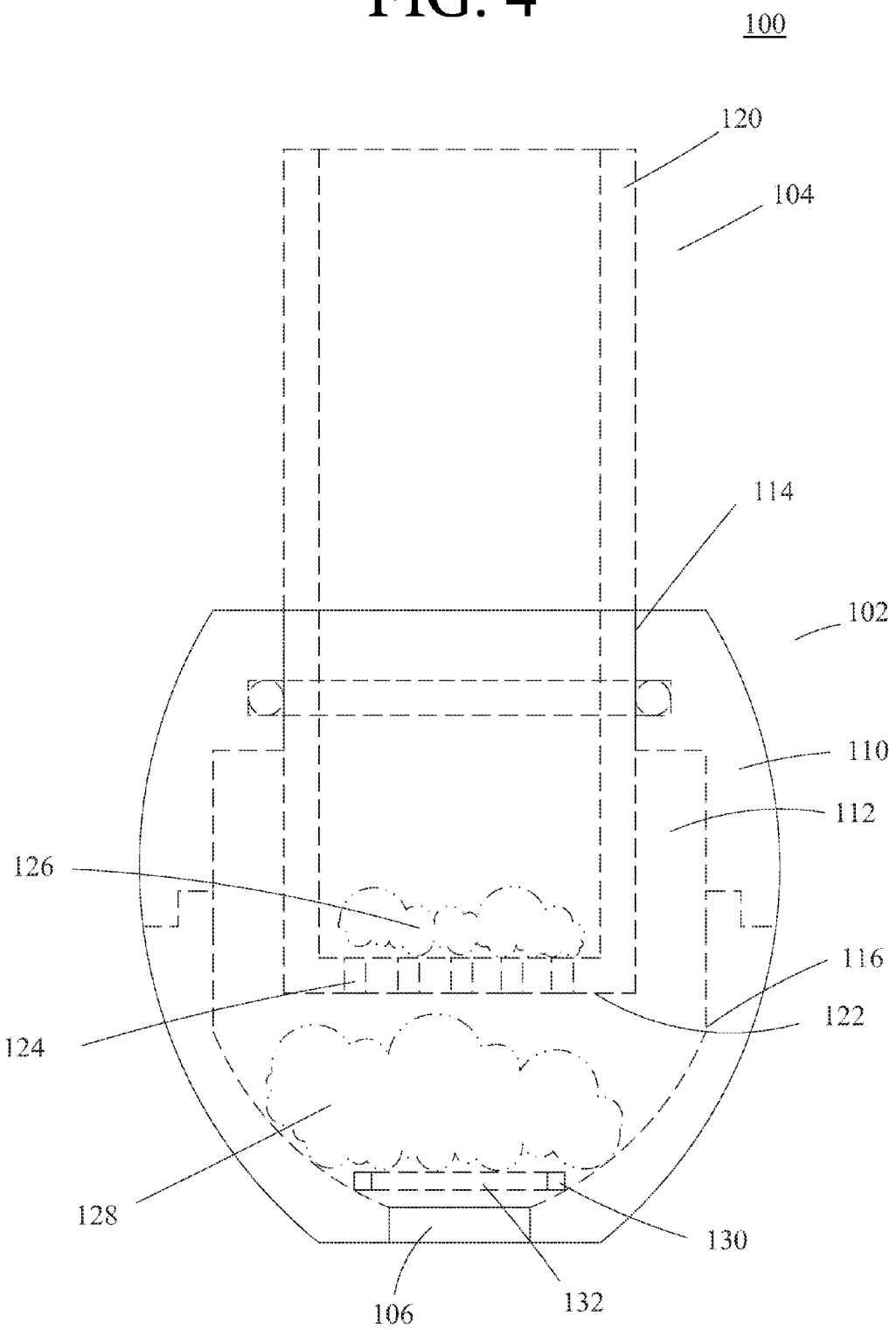
FIG. 4 is an exposed, orthographic view of the hookah bowl.
Figure 5:
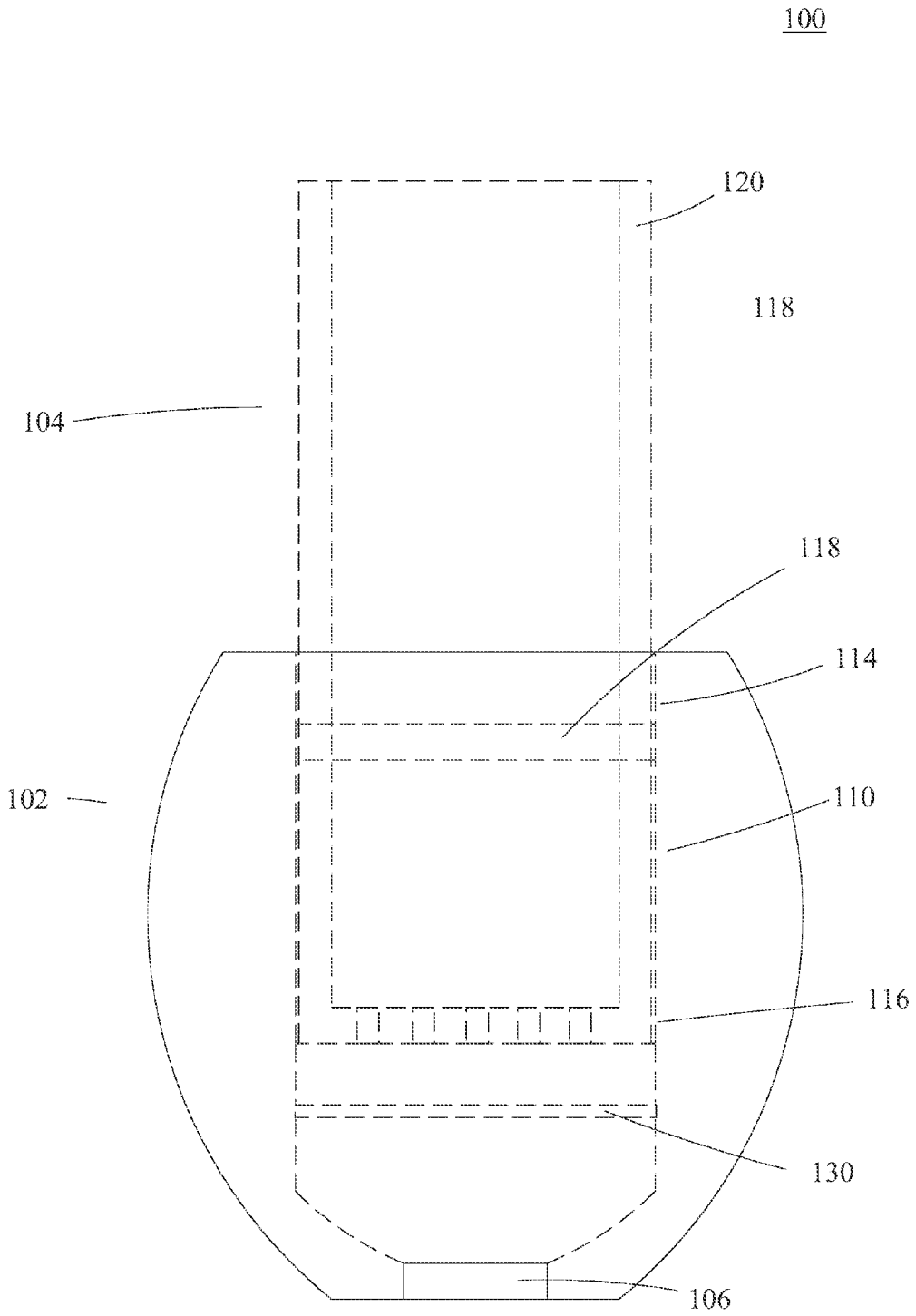
FIG. 5 is an exposed, orthographic view of the hookah bowl.
Figure 6:
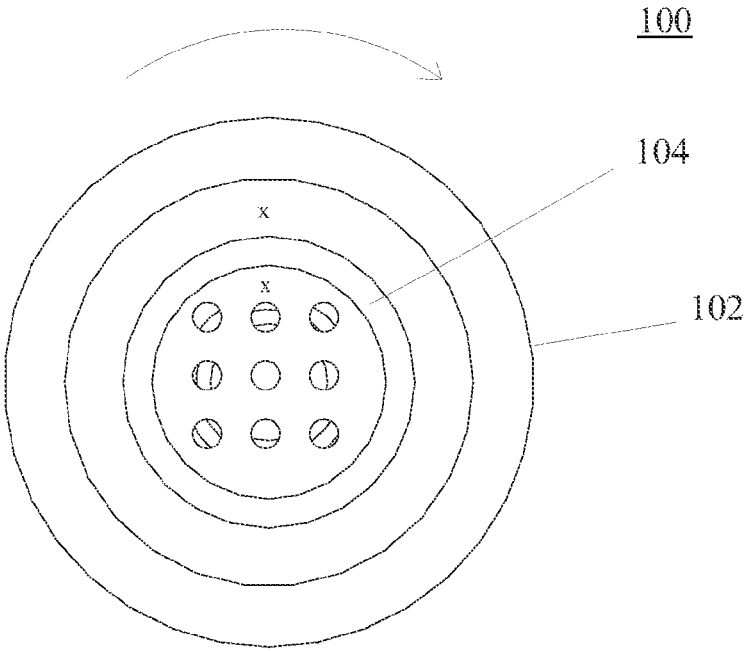
FIG. 6 is an upper, perspective view of the hookah bowl.
Figure 7:
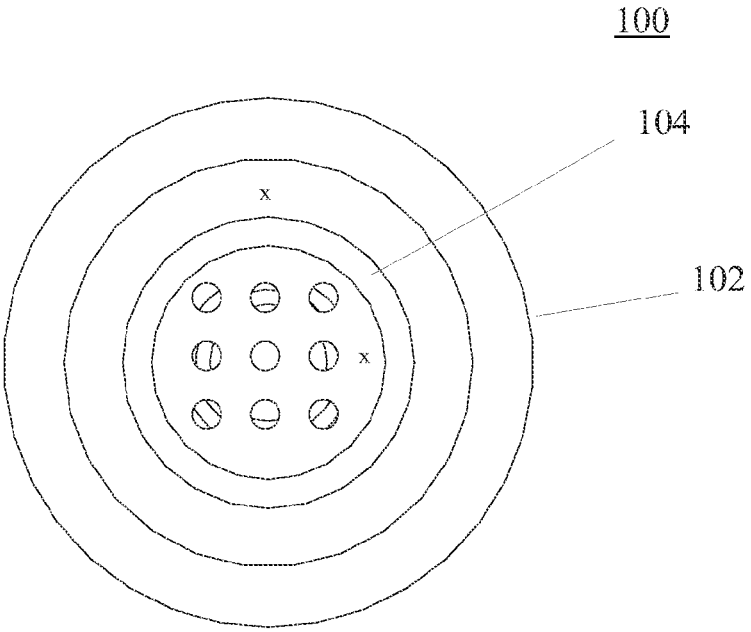
FIG. 7 is an upper, perspective view of the hookah bowl.
Figure 8:
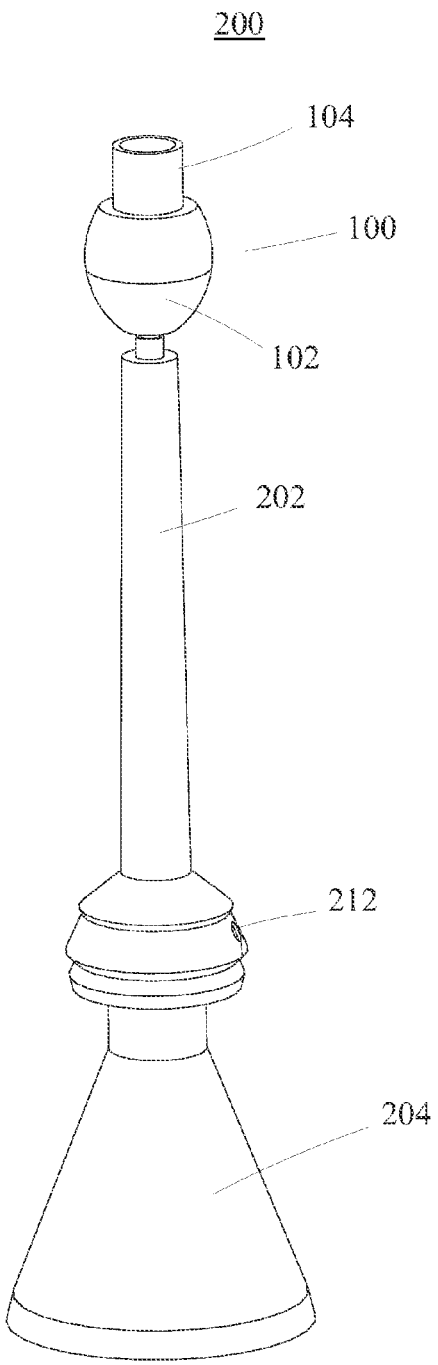
FIG. 8 is a side, perspective view of the hookah.
Figure 9:
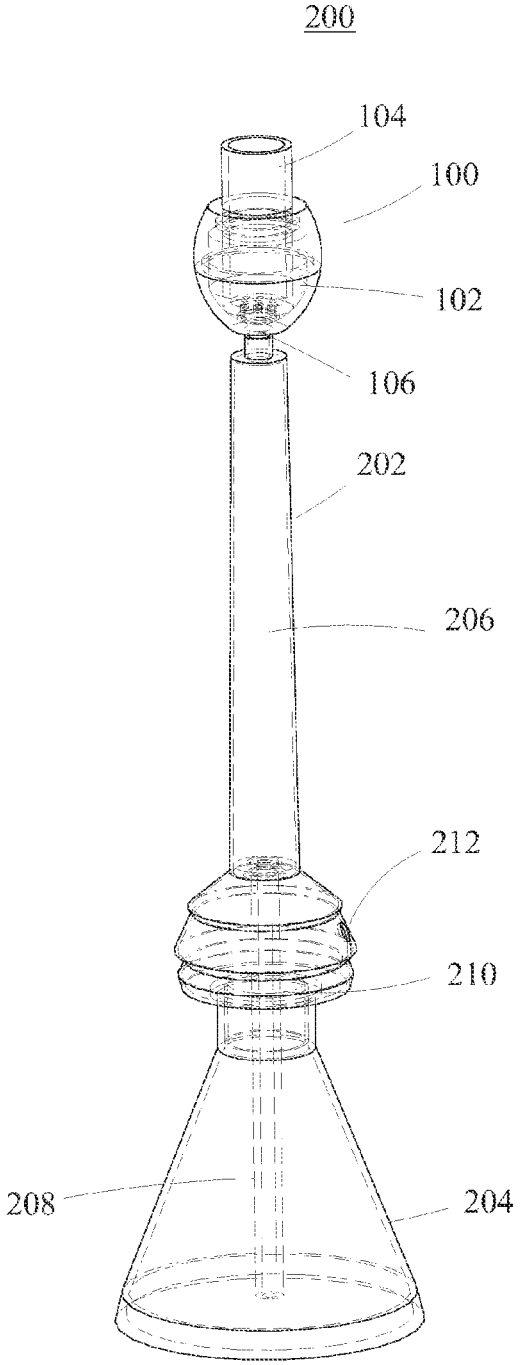
FIG. 9 is a side, exposed, perspective view of the hookah.

The burner 104 is positioned within the shell void 112 against the retainer member 118 and is sized to form a sealed fit therewith. The preferred burner 104 includes cylindrical dimensions with an open top and perforated base wall 122. The perforations 124 within the base wall 122 are sized to permit hookah coals to be placed within the burner without passage of the coals through the perforations. The burner 104 of the present invention is an actuating burner, that is to say that it moves about the retainer member 118. In certain embodiments of the present invention, the burner may move longitudinally within the shell as is shown in FIGS. 3-4. In such embodiments, the burner may be positioned upon a vertical track formed by the shell with protrusions on the burner. In certain embodiments of the present invention, the burner 104 may move radially within the shell 102 as is shown in FIGS. 5-6. In such embodiments, the burner may be positioned upon a horizontal radial track formed by the shell with protrusions on the burner. Use of a track permits motion in a generally single dimension; it preferred that the retainer member permit motion of the burner within the shell both radially and longitudinally.

Returning to FIGS. 1-3, preferred embodiments of present invention utilize as a retainer member 118 an elastic ring or mating threading. An elastic ring 118 is a preferred retainer member 118 as it permits motion both longitudinal and radial, either simultaneously or singly. There are circumstances in which a user may desire to move the burner base wall 122 longitudinally without altering the radial profile of the burner 104 within the shell 102. There are circumstances in which a user may desire to move the burner base wall 122 radially without altering the longitudinal profile of the burner 104 within the shell 102. Finally there are circumstances in which a user may desire to move the burner base wall 122 radially and alter the longitudinal profile of the burner 104 within the shell 102. As depicted in FIG. 5, another preferred retainer member 118 includes threaded zones on both the burner outer wall 120 and the shell retainer wall 114. The extent to which the burner outer wall 120 includes threading and the placement of the threading depends upon the degree to which it is desired to permit longitudinal actuation of the burner 104 within the shell 102. The threading pitch poses another consideration that may be tailored as desired; threading with a large pitch permits rapid longitudinal actuation of the burner, while threading with a small pitch permits substantial radial actuation with minimized longitudinal actuation. Threading is less preferred as longitudinal actuation without radial actuation, however slight, is not possible and vice versa.

The retainer member 118 seals and supports the shell-burner combination. As the shell 102 includes combusting massell purposed for the downward progression of dry smoke through the proximal aperture 106, the retainer member 118 prevents the noticeable escape of gas from the void 112 through the distal aperture 108. An elastic member as a retainer member 118 forms such a seal by creating an interference fit between the outer wall 120 of the burner 104 and the retainer wall 114 of the shell 102. An interference fit for purposes of this disclosure is a fit in which one component, here the shell-retainer-member-complex, includes a circumference that overlaps with the circumference of a second component, here the burner, and the circumference of an one component alters upon contact to accommodate the circumference of the other component. In addition to sealing the shell-burner complex, the retaining member 118 further provides the support necessary to support the burner 104 within the shell 102. By support it is meant that the retainer is capable of suspending the burner 104 in a fixed position either longitudinal or radial without substantial variation therefrom. Substantial variation is variation that affects the user's predetermined intent for the chosen position of the burner relative to the shell.

As shown in FIG. 4, a user places coal 126 on an upper portion of the base wall 122 of the burner 104 and upon a massell platform 130 positioned within the shell. The preferred massell platform 130 includes a removable disc having a screened interior 132 with perforations sized prevent the passage of substantial massell portions therethrough. Alternate versions of the massell platform may include a platform integrally affixed to the interior sidewall 110 of the shell 102 as is depicted in FIG. 5. Returning to FIG. 4, the user may then position the burner 104 within the shell void 112 against the retainer member 118 held by the retainer wall 114. The user may then position the burner base wall 122 at an appropriate position within the void 112 to burn the massell 128 at the rate desired. The user may alter the position longitudinally or radially or both as desired. When the user has finished burning the massell, the user may remove the burner 104 from the shell 102 for reloading, cleaning, etc. As is shown in FIG. 1, the shell 102 may be bifurcated into a proximal shell portion 102*b* and a distal shell portion 102*a* to further assist in the cleaning of the present invention. The preferred attachment means of the shell portions 102*a*, 102*b* includes threading or interference fitting.

As is shown in FIGS. 4-5, the shell 102 may include an interior wall 110 subdivided into two portions, a retainer wall 114 and a smoke wall 116. It is preferred that the interior wall 110 include varying dimensions, a substantially uniform portion that supports the retainer member 118 and a flared portion that offers a volume amenable to the placement and use of massell. It is preferred that the smoke wall 116 slope inward adjacent to the massell platform. Sloping sidewalls guide the massell to proper placement within the shell. It is further preferred that the smoke wall 118 include a circumference, at some portion, greater than that of the retainer wall 114 offer a greater volume for smoke within the shell to occupy. However, as FIG. 5, shows, there need not be any variation in the retainer wall 114 and the smoke wall 116 which may be substantially uniform and indistinguishable.

As heat from the combusted coals travels through the perforations 124 of the base wall 122, the natural exit for combusted smoke is downward through the proximal aperture 106. Thus, it is preferred to omit alternate low-pressure exits for the smoke within the shell 102. It is preferred that the shell 102 and portions of the burner outer wall be solid up to the retainer member 118. By solid, it is meant that a component lacks apertures leading to an external environment. Portions of the shell or burner above the retainer member may include apertures generally without consequence. It is preferred that the burner possess a height greater than the distance from the proximal aperture 106 to the distal aperture 108, i.e. the shell height. Although the burner need only include a burner height approximately equal to the distance from the lowest position of the massell platform 130 to the retainer member 118, a preferred embodiment of the present invention includes a height that positions the burner well above the distal aperture at all times to permit a user to adjust the position of the burner base wall 122 by hand actuation of the uppermost portions of the burner outer wall 120. To this end, the burner 104 may be constructed of a height resistant material.

A hookah 200 of the present invention includes the hookah bowl 100 positioned upon a hookah stem 202. The hookah stem 202 includes a dry smoke aperture 206 in sealed contact with the proximal aperture 106 of the hookah bowl 100. The hookah stem 202 includes a down tube 208 positioned to conduct dry smoke from the stem 202 into a hookah base 204 beneath the liquid therein. The hookah stem 202 includes a wet smoke inlet 210 to accept the upward passage of wetted smoke from the hookah base 204, and includes a wet smoke outlet 212 to pass the wetted smoke to a user.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A process for using a hookah, said process comprising:
placing massell within a hookah bowl comprising:
a bowl shell defining a proximal aperture, a distal aperture, and interior sidewall defining a central shell void, a retainer wall having a substantially uniform retainer wall circumference, and a smoke wall with a smoke wall circumference, wherein a shell height is a distance from said distal aperture to said proximal aperture;
a retainer member on said retainer wall;
a removable bowl burner, sealingly and supportingly contacting said retainer member and adapted for continuous and longitudinal actuation along said retainer member, having a burner height at least approximately equal to said shell height, an outer wall with an outer wall circumference approximately equal to said retainer wall circumference, and a perforated burner base wall; and
a massell platform, below said perforated burner base wall, with platform perforations sized to prevent substantial passage of massell portions through said proximal aperture;
positioning said hookah bowl burner within said hookah bowl shell in a first supported position such that said perforated burner base of said burner bearing lighted coals is positioned adjacent to said massell; and
longitudinally adjusting a position of said bowl burner in a continuous manner within said hookah bowl shell to a second supported position such that said perforated burner base is positioned adjacent to said massell.

2. The process of claim 1 wherein said longitudinally adjusting step includes longitudinally adjusting a position of said bowl burner in a continuous manner along a substantially static radial path.

3. A process for using a hookah, said process comprising:
placing massell within a hookah bowl comprising:
a bowl shell defining a proximal aperture, a distal aperture, and interior sidewall defining a central shell void, a retainer wall having a substantially uniform retainer wall circumference, and a smoke wall with a smoke wall circumference, wherein a shell height is a distance from said distal aperture to said proximal aperture;
a retainer member on said retainer wall;
a removable bowl burner, sealingly and supportingly contacting said retainer member and adapted for continuous and longitudinal actuation along said retainer member, having a burner height at least approximately equal to said shell height, an outer wall with an outer wall circumference approximately equal to said retainer wall circumference, and a perforated burner base wall; and
a massell platform, below said perforated burner base wall, with platform perforations sized to prevent substantial passage of massell portions through said proximal aperture;
positioning said hookah bowl burner within said hookah bowl shell in a first supported position such that said perforated burner base of said burner bearing lighted coals is positioned adjacent to said massell; and
radially adjusting a position of said bowl burner in a continuous manner within said hookah bowl shell to a second supported position such that said perforated burner base is positioned adjacent to said massell.

4. The process of claim 3 wherein said longitudinally adjusting step includes radially adjusting a position of said bowl burner in a continuous manner along a substantially static longitudinal path.

* * * * *